US010724741B2

(12) United States Patent
Yellapantula et al.

(10) Patent No.: US 10,724,741 B2
(45) Date of Patent: Jul. 28, 2020

(54) COMBUSTORS AND METHODS OF ASSEMBLING THE SAME

(71) Applicant: General Electric Company, Schenectady, NY (US)

(72) Inventors: Shashank Yellapantula, Guilderland, NY (US); Anthony John Dean, Scotia, NY (US); Narendra Digamber Joshi, Guilderland, NY (US); Mehmet Muhittin Dede, Liberty Township, OH (US); Jin Yan, Niskayuna, NY (US); Owen James Sullivan Rickey, Saratoga Springs, NY (US)

(73) Assignee: General Electric Company, Schenectady, NY (US)

( * ) Notice: Subject to any disclaimer, the term of this patent is extended or adjusted under 35 U.S.C. 154(b) by 1067 days.

(21) Appl. No.: 15/150,844

(22) Filed: May 10, 2016

(65) Prior Publication Data

US 2017/0328569 A1 Nov. 16, 2017

(51) Int. Cl.
*F23R 3/34* (2006.01)
*F23R 3/28* (2006.01)

(52) U.S. Cl.
CPC ..... *F23R 3/34* (2013.01); *F23R 3/28* (2013.01); *F23R 3/346* (2013.01); *F23C 2201/20* (2013.01); *F23C 2201/30* (2013.01)

(58) Field of Classification Search
CPC .... F23R 3/28; F23R 3/34; F23R 3/346; F23R 3/336; F02C 7/22; F23C 2201/20; F23C 2201/30
See application file for complete search history.

(56) References Cited

U.S. PATENT DOCUMENTS 3,763,650 A * 10/1973 Hussey ..... F23D 11/104 239/561
4,185,458 A 1/1980 Ernst
(Continued)

FOREIGN PATENT DOCUMENTS

WO 9412815 A1 6/1994
WO 2009141498 A2 11/2009
WO 2015095759 A1 6/2015

OTHER PUBLICATIONS

Bester et al., "Assessment of the Operational Performance of Fischer-Tropsch Synthetic-Paraffinic Kerosene in a T63 Gas Turbine Compared to Conventional Jet A-1 Fuel", Combustion, Fuels and Emissions, ASME Turbo Expo 2009: Power for Land, Sea, and Air, Paper No: GT2009-60333, vol. 2, pp. 1063-1077, Jun. 8-12, 2009, Orlando, Florida, USA.
(Continued)

*Primary Examiner* — Scott J Walthour
*Assistant Examiner* — Jacek Lisowski
(74) *Attorney, Agent, or Firm* — Armstrong Teasdale LLP

(57) ABSTRACT

A fuel nozzle assembly includes a centerbody including an outer wall. The outer wall defines a plurality of fuel injection apertures. The fuel injection apertures include a first portion of the plurality of fuel injection apertures configured to induce a first fuel flow rate. The fuel injection apertures also include a second portion of the plurality of fuel injection apertures configured to induce a second fuel flow rate. The second fuel flow rate is less than the first fuel flow rate.

17 Claims, 10 Drawing Sheets

(56) References Cited

U.S. PATENT DOCUMENTS 5,218,824 A * 6/1993 Cederwall ..... F23C 7/008 239/403
5,289,686 A 3/1994 Razdan et al.
5,947,389 A 9/1999 Hasegawa et al.
6,101,814 A 8/2000 Hoke et al.
6,192,689 B1 2/2001 Feitelberg et al.
6,389,792 B1 5/2002 Hagle et al.
6,434,945 B1 * 8/2002 Mandai ..... F23D 11/38 60/39.3
6,908,303 B1 6/2005 Oda et al.
8,555,645 B2 10/2013 Duncan et al.
8,806,871 B2 8/2014 McMasters et al.
2005/0204744 A1 9/2005 Schumacher et al.
2007/0271927 A1 * 11/2007 Myers ..... F02C 9/28 60/776
2009/0255256 A1 * 10/2009 McMasters ..... B22F 3/1055 60/734
2009/0255262 A1 * 10/2009 McMasters ..... F23R 3/14 60/742
2009/0255264 A1 10/2009 McMasters et al.
2010/0269506 A1 * 10/2010 Nonaka ..... F23D 11/386 60/742
2013/0276450 A1 10/2013 Baruah et al.
2014/0096526 A1 * 4/2014 Marquez ..... F23N 1/007 60/734
2014/0130772 A1 5/2014 Maeda et al.
2014/0157787 A1 * 6/2014 Bathina ..... F02C 9/40 60/776

OTHER PUBLICATIONS

Wei et al., "Experimental Study on External Supercharging of DI Diesel Engine with Swirl Chamber Combustion System", Computer Distributed Control and Intelligent Environmental Monitoring (CDCIEM), 2011 International Conference on, pp. 778-781, Feb. 19-20, 2011, Changsha.

* cited by examiner

COMBUSTORS AND METHODS OF ASSEMBLING THE SAME

BACKGROUND

The field of the invention relates generally to turbine engines, and more particularly, to combustors and fuel nozzle assemblies within turbine engines.

At least some known turbine engines include a forward fan, a core engine, and a power turbine. The core engine includes at least one compressor that provides pressurized air to a combustor where the air is mixed with fuel and ignited for use in generating hot combustion gases. Many such known turbine engines typically include a plurality of fuel nozzles for supplying fuel to the combustor in the core engine. The fuel is introduced at the front end of a burner in a highly atomized spray from at least one of the fuel nozzles. Compressed air flows around the fuel nozzle and mixes with the fuel to form a fuel-air mixture, which is ignited by the burner. The fuel nozzles have swirler assemblies that swirl the air passing through them to promote mixing of air with fuel prior to combustion. The swirler assemblies used in the combustors may be complex structures having axial, radial, or conical swirlers or a combination of them. Generated combustion gases flow downstream to one or more power turbines that extract energy from the gas to power the compressor and provide useful work, such as powering an aircraft.

In at least some known combustors, fuel and air are injected into an oxidizer stream from respective pluralities of circumferentially-spaced outlets. The independent streams of fuel and air interact to form a mixture, which produces a lean combustion flame that reduces NOx emissions. However, in some known systems, the fuel nozzles are configured such that fuel injection through the fuel nozzles sometimes results in fuel directed towards the liners of the combustor where combustion occurs. Such close proximity of combustion to the liners increases their thermal loading, thereby decreasing a margin to thermal parameters of the liners and potentially decreasing their service life. In general, in some such known fuel nozzles, the fuel nozzles include a plurality of circumferentially positioned fuel feed apertures that are substantially similar in size. A clockwise swirl within the fuel nozzle entrains fuel injected through the apertures at substantially similar fuel flow rates and some of the fuel injected from certain apertures is directed toward the liners.

BRIEF DESCRIPTION

In one aspect, a fuel nozzle assembly is provided. The fuel nozzle assembly includes a centerbody including an outer wall. The outer wall defines a plurality of fuel injection apertures that include a first portion of the plurality of fuel injection apertures configured to induce a first fuel flow rate. The plurality of fuel injection apertures also include a second portion of the plurality of fuel injection apertures configured to induce a second fuel flow rate. The second fuel flow rate is less than the first fuel flow rate.

In another aspect, a combustor for a turbine engine assembly is provided. The combustor includes a plurality of liners that at least partially define a combustion chamber. The combustor also includes a fuel nozzle assembly communicatively coupled with the combustion chamber. The fuel nozzle assembly includes a centerbody including an outer wall. The outer wall defines a plurality of fuel injection apertures that include a first portion of the plurality of fuel injection apertures configured to induce a first fuel flow rate. The plurality of fuel injection apertures also include a second portion of the plurality of fuel injection apertures configured to induce a second fuel flow rate. The second fuel flow rate is less than the first fuel flow rate.

In another aspect, a method of assembling a combustor is provided. The method includes defining a combustion chamber at least partially with a plurality of liners. The method also includes manufacturing a fuel nozzle assembly comprising fabricating a centerbody such that an outer wall of the centerbody comprising defining a plurality of fuel injection apertures therein. The method further includes configuring a first portion of the plurality of fuel injection apertures with a first configuration to induce a first fuel flow rate. The method also includes configuring a second portion of the plurality of fuel injection apertures with a second configuration to induce a second fuel flow rate. The second fuel flow rate is less than the first fuel flow rate. The method further includes coupling the fuel nozzle assembly communicatively with the combustion chamber.

DRAWINGS

These and other features, aspects, and advantages of the present disclosure will become better understood when the following detailed description is read with reference to the accompanying drawings in which like characters represent like parts throughout the drawings, wherein.

Figure 1:
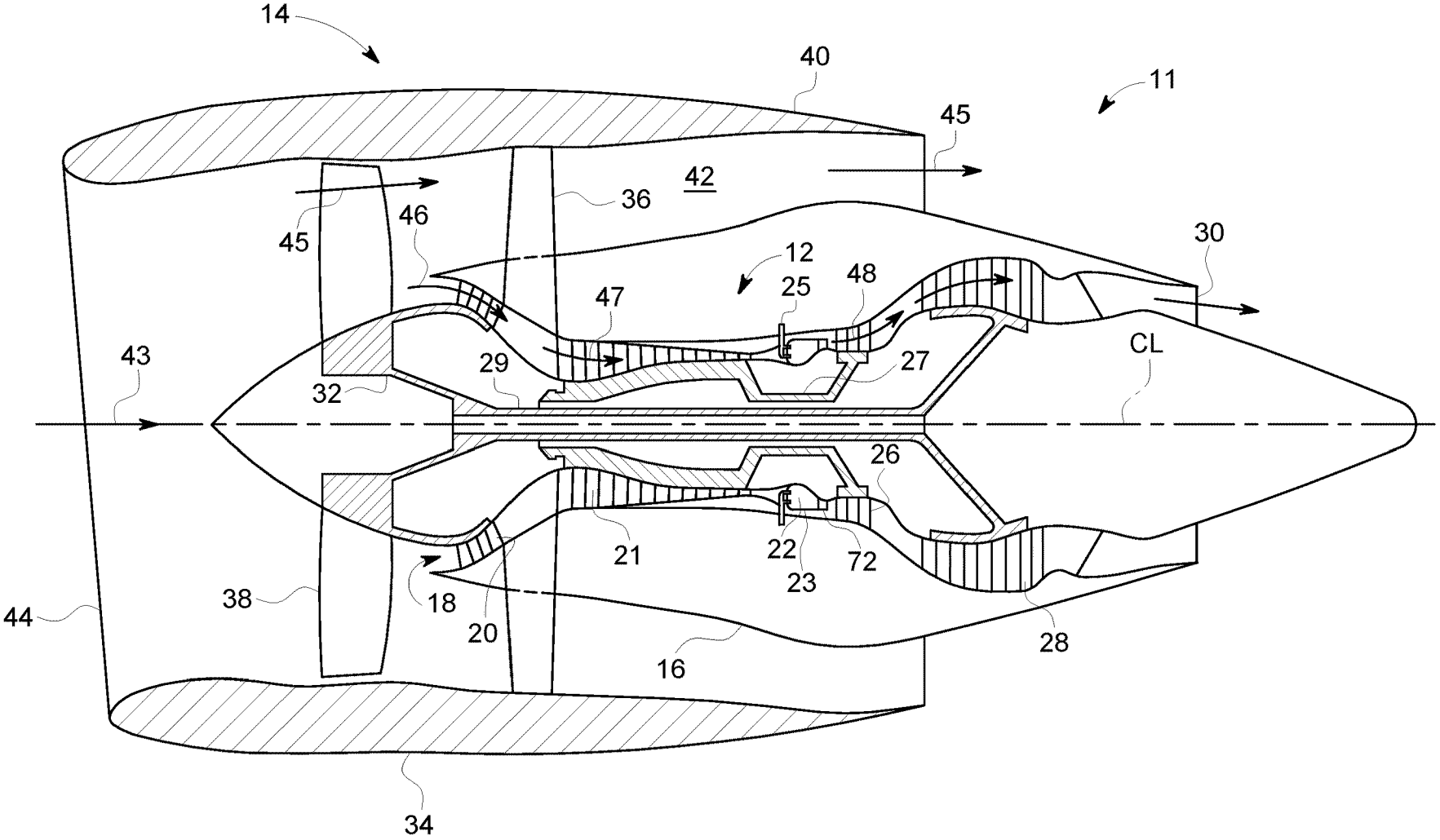
FIG. 1 is a cross-sectional schematic view of an exemplary turbine engine assembly.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations are combined and interchanged; such ranges are identified and include all the sub-ranges contained therein unless context or language indicates otherwise.

As used herein, the term "first end" is used throughout this application to refer to directions and orientations located upstream in an overall axial flow direction of fluids with respect to a center longitudinal axis of a combustion chamber. The terms "axial" and "axially" are used throughout this application to refer to directions and orientations extending substantially parallel to a center longitudinal axis of a combustion chamber. Terms "radial" and "radially" are used throughout this application to refer to directions and orientations extending substantially perpendicular to a center longitudinal axis of the combustion chamber. Terms "upstream" and "downstream" are used throughout this application to refer to directions and orientations located in an overall axial flow direction with respect to the center longitudinal axis of the combustion chamber.

The fuel injection systems described herein facilitate decreasing fuel injected into a combustor through a plurality of fuel nozzles from approaching and combusting in the vicinity of the combustors' outer liners and/or the inner liners. Also, a smaller portion of high-temperature combustion gases is directed toward the outer liners and the inner liners. As such, the thermal loading, i.e., temperature of the outer liners and the inner liners is significantly decreased, thereby increasing a margin to thermal parameters for the outer liners and the inner liners and extending their service life. In the embodiments disclosed herein, at least a portion of circumferential apertures defined in the center bodies of the fuel nozzles are sized differently, thereby tuning the fuel nozzles. More specifically, a first portion of selected apertures are increased in size to substantially maintain a predetermined total fuel flow through the full set of apertures into the fuel nozzles while a second portion of selected apertures are decreased in size to facilitate a decrease in flow through the selected apertures. The selection of the apertures to decrease in size is at least partially based on the characteristics of the clockwise swirl induced within the centerbody. As such, the flow rate of fuel is controlled at each injection point, i.e., aperture to preferentially distribute the fuel injection to facilitate regulation of the temperature on the inner and outer liners through a known relationship between a percentile biasing of the fuel flow through each aperture to attain a predetermined temperature change in the temperature of the liners.

FIG. 1 shows a cross-sectional view of an exemplary turbine engine assembly 11 having a longitudinal or centerline axis CL therethrough. Although FIG. 1 shows a turbine engine assembly for use in an aircraft, assembly 11 is any turbine engine that facilitates operation as described herein, such as, but not limited to, a ground-based gas turbine engine assembly. Assembly 11 includes a core turbine engine 12 and a fan section 14 positioned upstream of core turbine engine 12. Core engine 12 includes a generally tubular outer casing 16 that defines an annular inlet 18. Outer casing 16 further encloses and supports a booster compressor 20 for raising the pressure of air entering core engine 12. A high pressure, multi-stage, axial-flow high pressure compressor 21 receives pressurized air from booster 20 and further increases the pressure of the air. The pressurized air flows to a combustor 22, generally defined by a combustion liner 23, and including a main swirler 24 (sometimes referred to as a main mixer), where fuel is injected into the pressurized air stream, via one or more fuel nozzles 25 to raise the temperature and energy level of the pressurized air. The high energy combustion products flow from combustor 22 to a first (high pressure) turbine 26 for driving high pressure compressor 21 through a first (high pressure) drive shaft 27, and then to a second (low pressure) turbine 28 for driving booster compressor 20 and fan section 14 through a second (low pressure) drive shaft 29 that is coaxial with first drive shaft 27. After driving each of turbines 26 and 28, the combustion products leave core engine 12 through an exhaust nozzle 30 to provide propulsive jet thrust.

Fan section 14 includes a rotatable, axial-flow fan rotor 32 that is surrounded by an annular fan casing 34. It will be appreciated that fan casing 34 is supported from core engine 12 by a plurality of substantially radially-extending, circumferentially-spaced outlet guide vanes 36 and fan frame struts 36 (both labeled 36). In this way, fan casing 34 encloses the fan rotor 32 and a plurality of fan rotor blades 38. A downstream section 40 of fan casing 34 extends over an outer portion of core engine 12 to define a secondary, or bypass, airflow conduit 42 that provides propulsive jet thrust.

In operation, an initial air flow 43 enters turbine engine assembly 11 through an inlet 44 to fan casing 34. Air flow 43 passes through fan blades 38 and splits into a first air flow (represented by arrow 45) and a second air flow (represented by arrow 46) which enters booster compressor 20. The pressure of the second air flow 46 is increased and enters high pressure compressor 21, as represented by arrow 47. After mixing with fuel and being combusted in combustor 22 combustion products 48 exit combustor 22 and flow through the first turbine 26. Combustion products 48 then flow through the second turbine 28 and exit the exhaust nozzle 30 to provide thrust for the turbine engine assembly 11.

Fuel nozzles 25 disposed within main swirler 24 intake fuel from a fuel supply (e.g., liquid and/or gas fuel), mix the fuel with air, and distribute the air-fuel mixture into combustor 22 in a suitable ratio for optimal combustion, emissions, fuel consumption, and power output. Turbine engine assembly 11 includes main swirler 24 including the one or more fuel nozzles 25, having a fuel injection system, described in further detail below.

Figure 2:
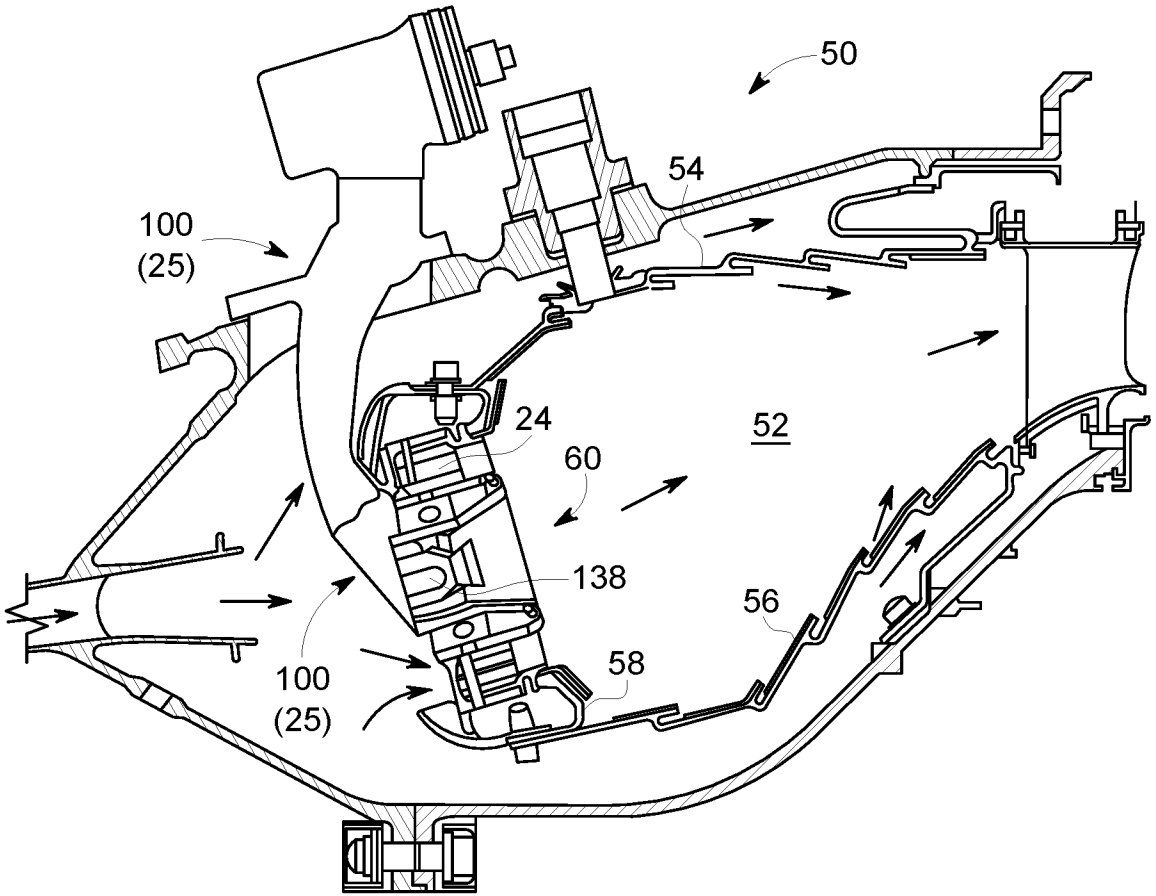
FIG. 2 is a cross-sectional schematic view of a portion of an exemplary combustor that may be used with the turbine engine assembly shown in FIG. 1.

FIG. 2 is a cross-sectional view of a portion of an exemplary combustor 50 that may be used with turbine engine assembly 11. Combustor 50 defines a combustion chamber 52 in which combustor air is mixed with fuel and combusted. Combustor 50 includes an outer liner 54 and an inner liner 56. Outer liner 54 defines an outer boundary of the combustion chamber 52, and inner liner 56 defines an inner boundary of combustion chamber 52. An annular dome 58 is mounted upstream from outer liner 54 and inner liner 56 defines an upstream end of combustion chamber 52. One or more fuel injection systems 60 are positioned on dome 58. In the exemplary embodiment, each fuel injection system 60 includes a fuel nozzle assembly 100 described in further detail below, and described in general in FIG. 1 as plurality of fuel nozzles 25. Fuel nozzle assembly 100 facilitates delivery of a mixture of fuel and air to combustion chamber 52. Other features of combustion chamber 52 are conventional and will not be discussed in further detail.

Figure 3:
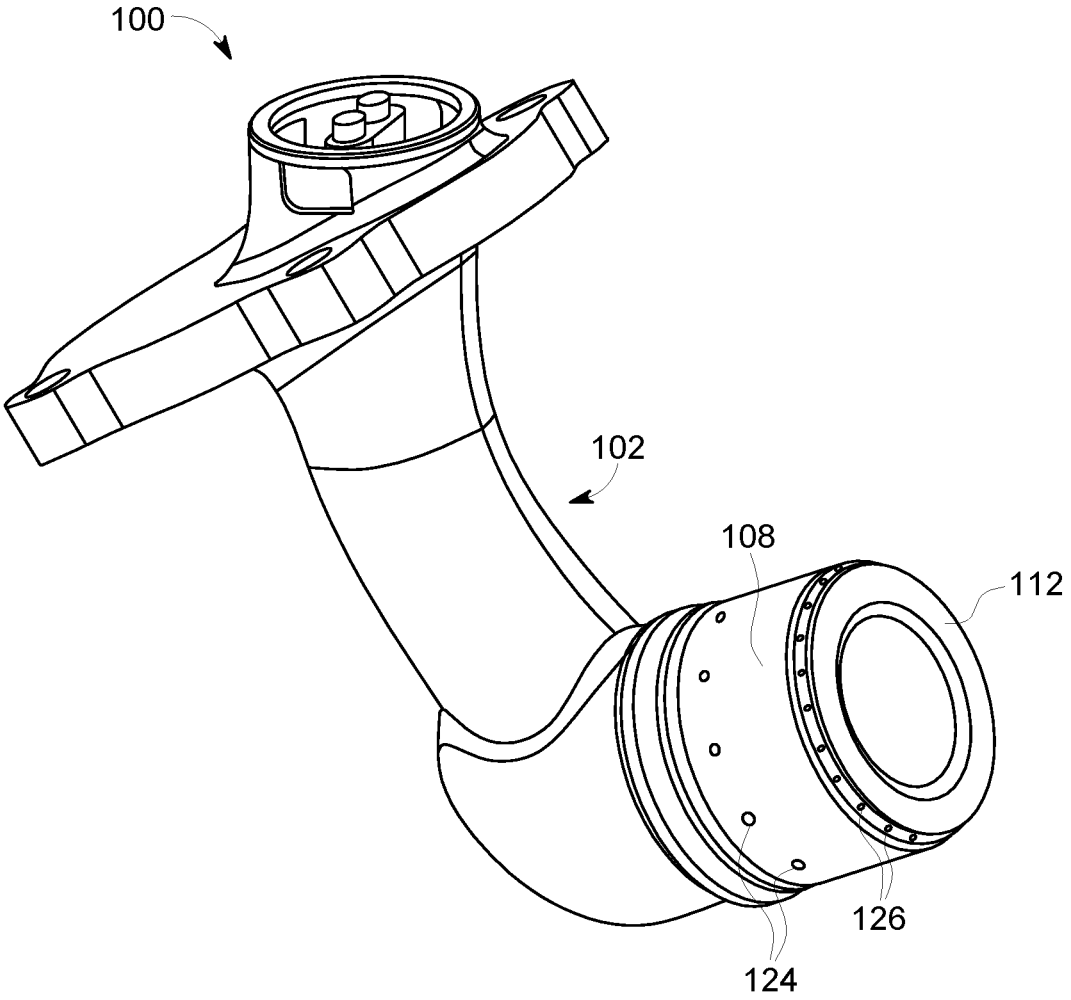
FIG. 3 is a schematic perspective view of an exemplary fuel nozzle assembly that may be used with the combustor shown in FIG. 2.
Figure 4:
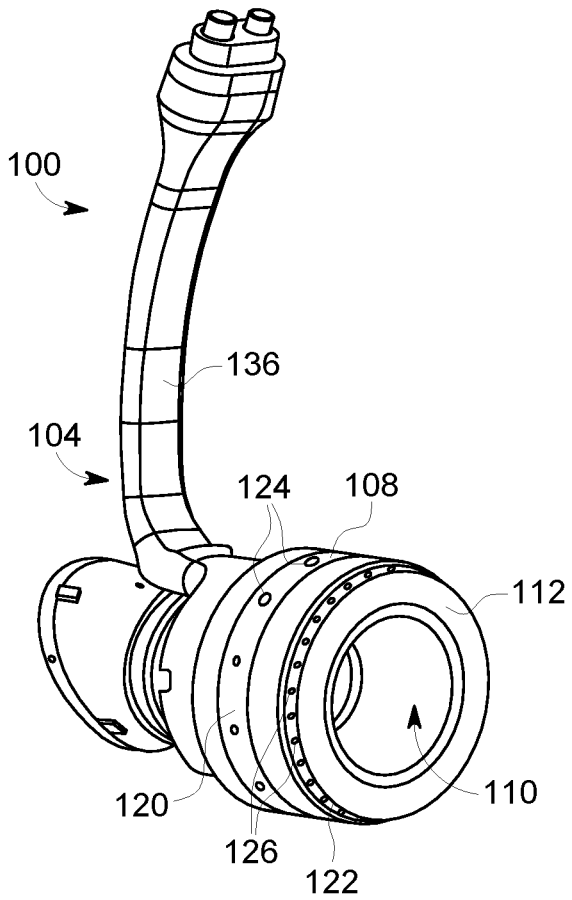
FIG. 4 is a schematic view of the fuel nozzle assembly shown in FIG. 3 with the associated housing removed from an aft perspective looking forward.
Figure 5:
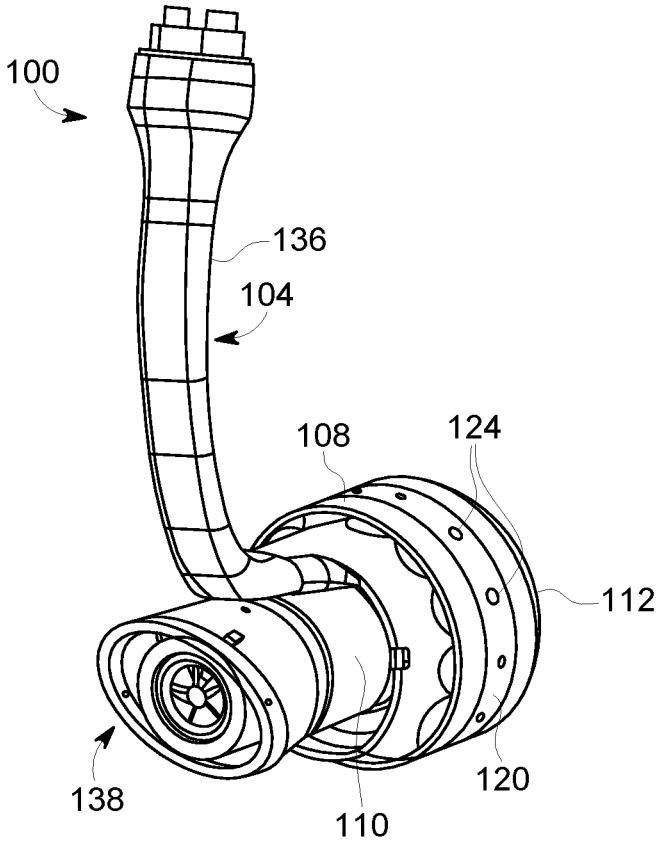
FIG. 5 is a schematic view of the fuel nozzle assembly shown in FIG. 4 from a forward perspective looking aft.
Figure 6:
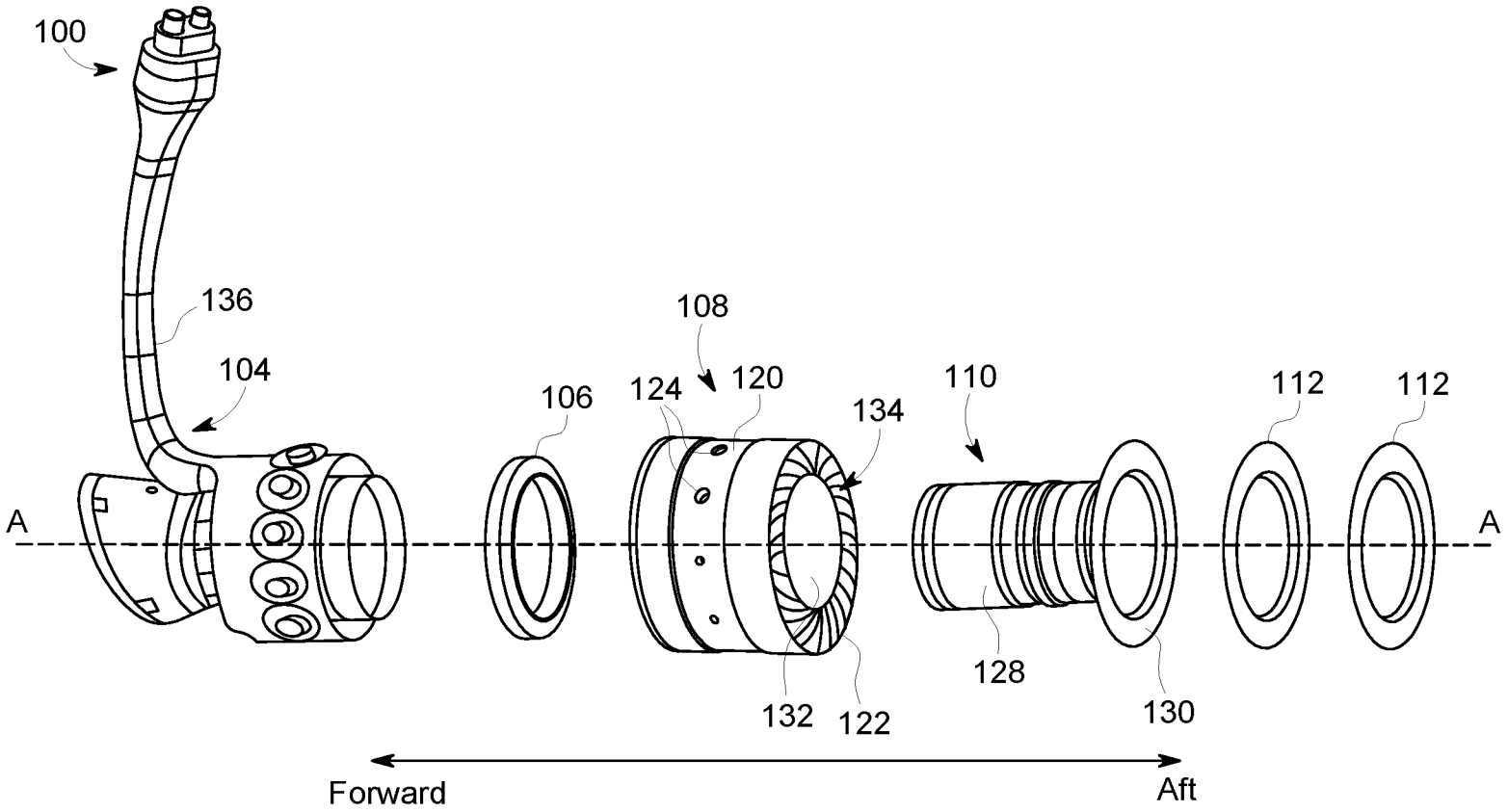
FIG. 6 is an exploded schematic view of the fuel nozzle assembly shown in FIGS. 4 and 5.

FIG. 3 is a schematic perspective view of an exemplary fuel nozzle assembly 100 that may be used with combustor 50 (shown in FIG. 2). Fuel nozzle assembly 100 is substantially equivalent to fuel nozzle 25 (shown in FIG. 1). FIG. 4 is a schematic view of fuel nozzle assembly 100 from an aft perspective looking forward with the associated housing 102 removed. FIG. 5 is a schematic view of fuel nozzle assembly 100 from a forward perspective looking aft. FIG. 6 is an exploded schematic view of fuel nozzle assembly 100. In the exemplary embodiment, fuel nozzle assembly 100 includes housing 102, a fuel delivery system 104, a plug 106, a centerbody 108, a venturi 110, and a heat shield 112. Heat shield 112 is any suitable thermal barrier substrate or coating having any suitable number of layers.

Centerbody 108 is substantially annular and includes an outer sidewall 120 and an end wall 122 extending inward from outer sidewall 120. Outer sidewall 120 has a plurality of circumferentially spaced fuel injection apertures 124 and end wall 122 has a plurality of cooling apertures 126. Venturi 110 includes a tubular segment 128 and a flange 130 extending outward from tubular segment 128. Centerbody 108 includes an inner wall 132, where inner wall 132, outer sidewall 120, and end wall 122 define a substantially annular passage 134.

Fuel delivery system 104 includes a fuel nozzle stem 136 coupled to a fuel source (not shown) where fuel nozzle stem 136 delivers fuel to the remainder for fuel nozzle assembly 100. Fuel nozzle assembly 100 further includes a pilot swirler 138 (sometimes referred to as a pilot mixer) that receives air flow 47 from high pressure compressor 21 (both shown in FIG. 1) and imparts a swirling motion thereto. Moreover, fuel nozzle assembly 100 includes main swirler 24 (shown in FIGS. 1 and 2) extending radially outboard of, and around, centerbody 108, where main swirler 24 also receives air flow 47 from high pressure compressor 21 and imparts a swirling motion thereto.

In operation when thrust is necessary, e.g., without limitation, take-off and climbing, fuel (not shown in FIGS. 3-6) is introduced at the forward end of fuel nozzle assembly 100 through fuel nozzle stem 136 to centerbody 108. A majority of the fuel is channeled radially outward through apertures 124. In addition, air flow 47 from high pressure compressor 21 is received by main swirler 24 and a swirling motion is imparted to generate swirling air (not shown). A swirling motion to the highly atomized fuel is induced as the fuel mixes with the swirling air to form a fuel-air mixture, which is ignited by a burner and ejected into combustion chamber 52 (shown in FIG. 2).

As used herein, references to fuel nozzle assembly 100 in terms of orientation within turbine engine assembly 11 (e.g., references such as "forward," "aft," "radially outward," and "radially inward") are intended to mean that fuel nozzle assembly 100, or individual components thereof, is configured to be oriented in such a manner that when fuel nozzle assembly 100 is mounted within turbine engine assembly 11 as described herein, and such references to orientation are not intended to limit the scope of this disclosure to only those fuel nozzle assemblies that are actually mounted within turbine engine assembly 11. Rather, this disclosure is intended to apply to fuel nozzle assemblies in general, whether mounted within a turbine engine assembly or not.

Figure 7:
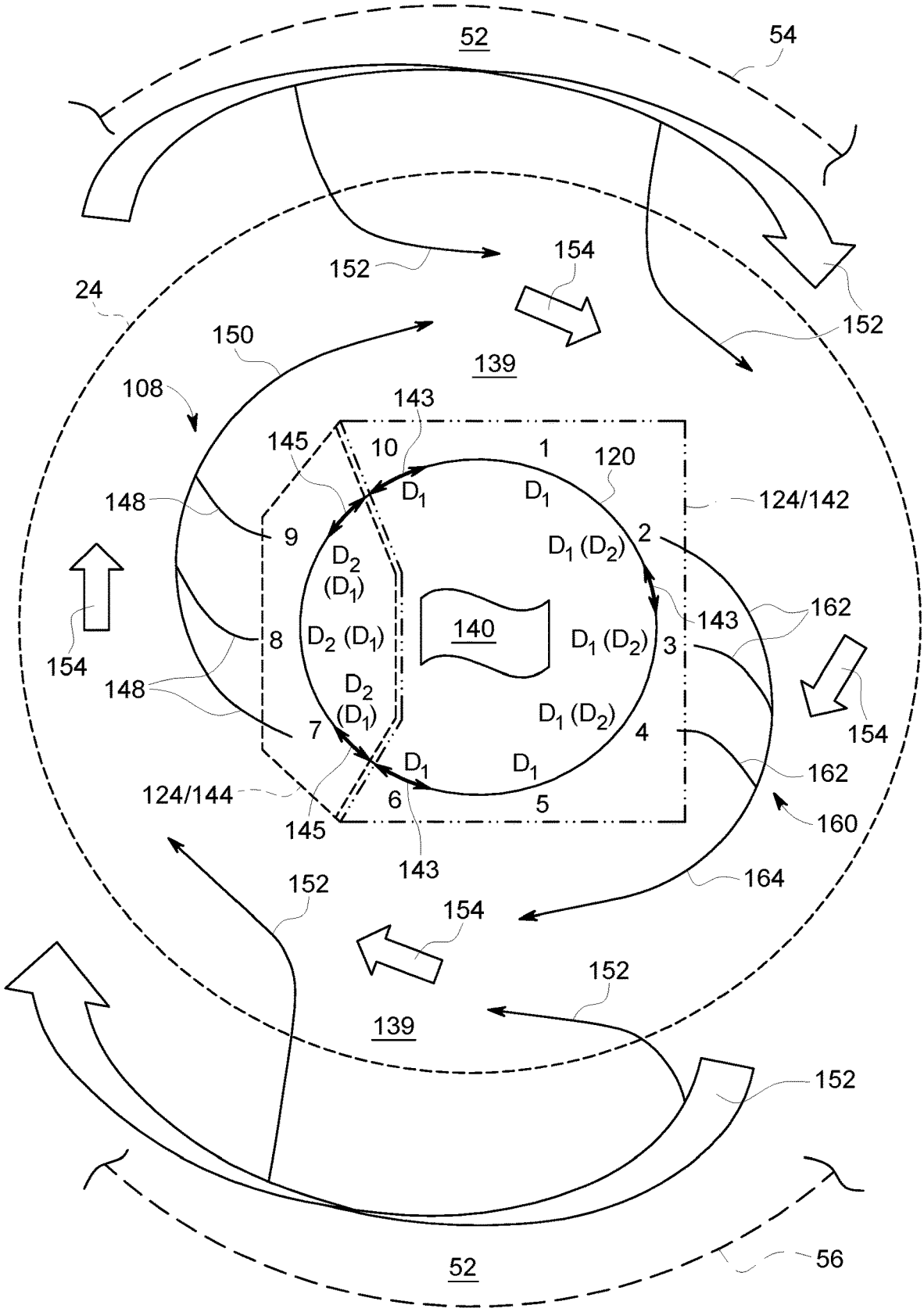
FIG. 7 is a schematic view from an aft perspective looking forward of an exemplary centerbody of the fuel nozzle assembly shown in FIGS. 4-6.
Figure 8:
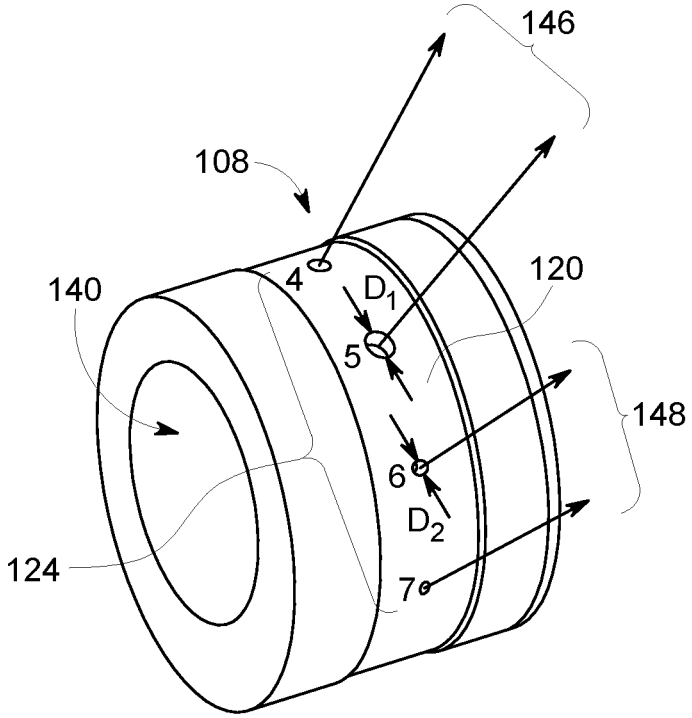
FIG. 8 is a schematic perspective view of the centerbody shown in FIG. 7.

FIG. 7 is a schematic view from an aft perspective looking forward to centerbody 108 of fuel nozzle assembly 100 (shown in FIGS. 4-6). FIG. 8 is a schematic perspective view of centerbody 108. In the exemplary embodiment, circumferentially positioned and substantially equidistantly spaced fuel injection apertures 124 include apertures numbered 1 through 10. Alternatively, centerbody 108 includes any number of circumferentially and equidistantly spaced fuel injection apertures 124 that enables operation of centerbody 108 and fuel nozzle assembly 100 as described herein, including, without limitation, 8 and 12. Main swirler 24 extends around centerbody 108, and main swirler 24 and centerbody 108 define a swirl chamber 139 therebetween. Fuel 140 is delivered to centerbody 108 from fuel nozzle stem 136 (shown in FIGS. 4-6). The spatial relationship of outer liner 54, inner liner 56, main swirler 24, and centerbody 108 are not shown to scale. Outer liner 54 and inner liner 56 are shown in phantom and are positioned aft of centerbody 108, main swirler 24, and swirl chamber 139 such that combustion chamber 52 is aft of, and coupled in flow communication with, xswirl chamber 139.

In the exemplary embodiment, a first portion 142 of fuel injection apertures 124 includes apertures 1-6 and 10. Apertures 1-6 and 10 have a first configuration defined by a first area, e.g., each of apertures 1-6 and 10 are substantially circular with a first diameter $D_1$. A second portion 144 of fuel injection apertures 124 includes apertures 7-9. Apertures 7-9 have a second configuration defined by a second area, e.g., each of apertures 7-9 are substantially circular with a second diameter $D_2$ that is less than first diameter $D_1$. In alternative embodiments, apertures 1-6 and 10 and apertures 7-9 have any diameters that enable operation of centerbody 108 as described herein, including, without limitation, a different diameter for each of the ten apertures 124. Further, in alternative embodiments, first portion 142 and second portion 144 of fuel injection apertures 124 have any number of apertures therein that enables operation of centerbody 108 as described herein, e.g., and without limitation, an alternative first portion 142 includes apertures 1-6 and 10, while an alternative second portion 144 includes apertures 7-9.

Also, in the exemplary embodiment, first portion 142 defines a first arc 143 of a circle defined circumferentially on outer sidewall 120 and second portion 144 defines a second arc 145 of the circle defined circumferentially on outer sidewall 120. A first radial fuel exit stream 146 (only shown in FIG. 8) through each of apertures 1-6 and 10 and a second radial fuel exit stream 148 through each of apertures 7-9 is induced. In the exemplary embodiment, each second radial fuel exit stream 148 has a flow rate that is approximately 5% lower than a known centerbody (not shown) with all ten apertures substantially identical in size inducing substantially similar flow rates through each of the ten apertures. Therefore, apertures 7-9 induce a total second radial fuel exit stream 150 representing an approximate 15% reduction in the total flow rate. As such, apertures 1-6 and 10 are sized to induce a total first radial fuel exit stream (not shown) that recovers the 15% reduction such that the total fuel injection through exemplary centerbody 108 and the known centerbody are substantially similar. Alternatively, the decreases and increases of the fuel flow associated with each individual aperture 124 are any values the enable operation centerbody 108 and fuel nozzle assembly 100 as described herein.

Further, in the exemplary embodiment, air 152 is introduced into swirl chamber 139 through swirl vanes (not shown) of main swirler 24. Air 152 mixes with fuel 140 to form a fuel-air mixture swirl 154 that is directed towards combustion chamber 52.

Moreover, in the exemplary embodiment, apertures 7-9 were selected for a reduction in diameter as a function of observed and/or modeled swirl patterns of fuel-air mixture swirl 154. The observed and/or modeled fuel flow from centerbody 124 results in decreasing fuel injected into combustor chamber 52 through each fuel nozzle assembly 100 from approaching and combusting in the vicinity of outer liners 54. Also, a smaller portion of high-temperature combustion gases is directed toward outer liners 54 since the reduced fuel exiting apertures 7-9 that is combusted achieves in a reduction in the combustion gases resulting therefrom. As such, the thermal loading of outer liners 54 is significantly decreased, thereby increasing a margin to thermal parameters for outer liners 54 and extending their service life. In the exemplary embodiment, the reduction in thermal loading of outer liners 54 is achieved through reducing the diameter of fuel apertures 7-9 and increasing the diameter of apertures 1-6 and 10. Alternatively, similar results may be achieved through one or more of, and without limitation, selectively altering the respective shapes of apertures 1 through 10, e.g., and without limitation, ovular shaped apertures, and installing flow restriction devices within apertures 7-9. Alternative embodiments including non-equidistantly spaced apertures 124 are discussed below with respect to FIG. 9.

In one embodiment of centerbody 108, as described above, apertures 7-9 induce a total second radial fuel exit stream 150 representing an approximate 15% reduction in the total flow rate. As such, apertures 1-6 and 10 are sized to induce a total first radial fuel exit stream that recovers the 15% reduction such that the total fuel injection through exemplary centerbody 108 and the known centerbody are substantially similar. As a result, a reduction of approximately 27 degrees Celsius (° C.) (80 degrees Fahrenheit (° F.)) to approximately 49° C. (120° F.) of outer liners 54 is achieved. The 27° C. to 49° C. range of temperature reduction is dependent on factors such as, and without limitation, the decrease in fuel flow rate, specific heat content of the fuel, and the fuel-air ratio in the combustor. Therefore, fuel nozzle assembly 100 inclusive of centerbody 108 is configured with a predetermined configuration to attain the predetermined decreases in temperatures of inner liners 56 and outer liners 54 through preferential distribution of fuel injection.

Similarly, in an alternative embodiment of centerbody 160 (only shown in FIG. 7), a reversal of sorts of first portion 142 of fuel injection apertures 124 and second portion 144 of fuel injection apertures 124 is illustrated. Specifically, apertures 2-4 now define the second portion of apertures 124 and apertures 1 and 5-10 now define the first portion of apertures 124, where the shift in configuration of apertures 2-4 and 7-9 is indicated by the parenthesized diameters ($D_1$) and ($D_2$). As a result, first arc 143 is shifted to include the portion of the circle defined by outer sidewall 120 including apertures 1 and 5-10 and second arc 145 is also shifted to include the portion of the circle defined by outer sidewall 120 including apertures 2-4. A first radial fuel exit stream (not shown) through each of apertures 1 and 5-10 and a second radial fuel exit stream 162 through each of apertures 2-4 are indiced. Therefore, apertures 2-4 induce a total second radial fuel exit stream 164 representing an approximate 15% reduction in the total flow rate. As such, apertures 1 and 5-10 are sized to induce a total first radial fuel exit stream (not shown) that recovers the 15% reduction such that the total fuel injection through exemplary centerbody 108 and the known centerbody are substantially similar.

Further, in this alternative embodiment, apertures 2-4 were selected for a reduction in diameter as a function of observed and/or modeled swirl patterns of fuel-air mixture swirl 154. The observed and/or modeled fuel flow from centerbody 124 results in decreasing fuel injected into combustor chamber 52 through each fuel nozzle assembly 100 from approaching and combusting in the vicinity of inner liners 56. Also, a smaller portion of high-temperature combustion gases is directed toward inner liners 56 since the reduced fuel exiting apertures 2-4 that is combusted achieves in a reduction in the combustion gases resulting therefrom. As such, the thermal loading of inner liners 56 is significantly decreased, thereby increasing a margin to thermal parameters for inner liners 56 and extending their service life. In this alternative embodiment, the reduction in thermal loading of inner liners 56 is achieved through reducing the diameter of fuel apertures 2-4 and increasing the diameter of apertures 1 and 5-10. Alternatively, similar results may be achieved through one or more of, and without limitation, selectively altering the respective shapes of apertures 1 through 10, e.g., and without limitation, ovular shaped apertures, and installing flow restriction devices within apertures 2-4.

In further alternative embodiments, both embodiments 108 and 160 are combined in that apertures 2-4 and 7-9 are tuned to bias both streams 150 and 164 to reduce the thermal loading of both outer liners 54 and inner liners 56. Specifically, both sets of apertures 2-4 and 7-9 have smaller diameters than apertures 1, 5-6, and 10. In still further alternative embodiments, any of, including all of, apertures 1-10 are tuned to facilitate reducing the thermal loading of outer liners 54 and/or inner liners 56.

Figure 9:
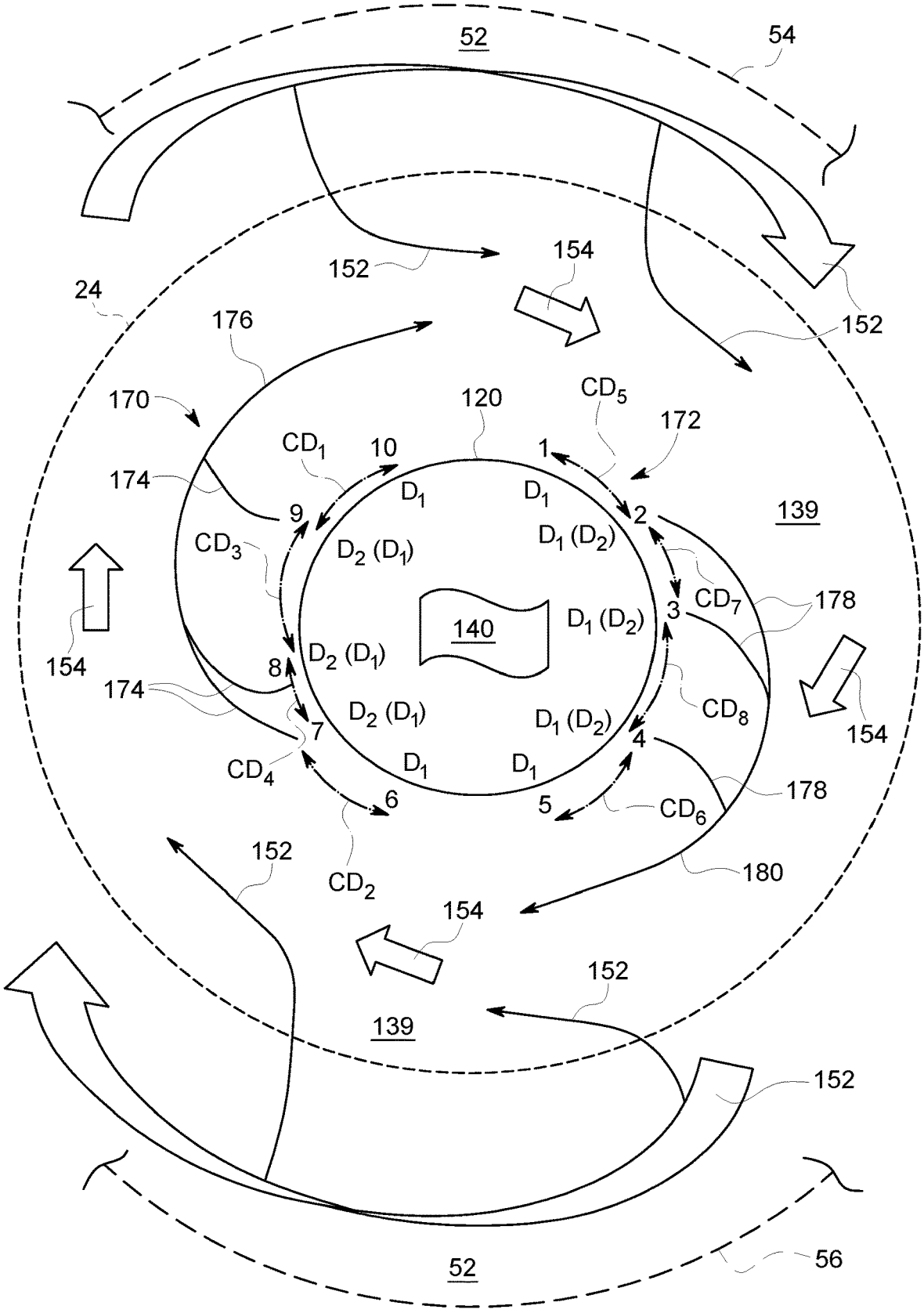
FIG. 9 is a schematic view from an aft perspective looking forward of an alternative centerbody of the fuel nozzle assembly shown in FIGS. 4-6.

FIG. 9 is a schematic view from an aft perspective looking forward of an alternative centerbody 170 of fuel nozzle assembly 100 (shown in FIGS. 4-6). Centerbody 170 is similar to centerbody 108 (shown in FIGS. 7 and 8). However, rather than circumferentially positioned and substantially equidistantly spaced fuel injection apertures 124, centerbody 170 includes a plurality of, i.e., ten fuel injection apertures 172 that are circumferentially positioned on outer sidewall 120, however at least a portion of adjacent fuel injection apertures 172 are non-equidistant. Specifically, in one embodiment, a first pair of adjacent apertures 9 and 10 define a first circumferential distance $CD_1$ therebetween and a second pair of adjacent apertures 6 and 7 define a second circumferential distance $CD_2$ therebetween, where $CD_1$ and $CD_2$ are substantially equal. Also, in this embodiment, a third pair of adjacent apertures 8 and 9 define a third circumferential distance $CD_3$ therebetween and a fourth pair of adjacent apertures 7 and 8 define a fourth circumferential distance $CD_4$ therebetween. $CD_3$ is less than $CD_4$, $CD_3$ is greater than $CD_1$ and $CD_2$, and $CD_4$ is less than $CD_1$ and $CD_2$.

In operation, fuel 140 is delivered to centerbody 108 from fuel nozzle stem 136 (shown in FIGS. 4-6). A first radial fuel exit stream (not shown) is induced through each of apertures 1-6 and 10 and a second radial fuel exit stream 174 is induced through each of apertures 7-9. In this alternative embodiment, each second radial fuel exit stream 174 has a flow rate that is approximately 5% lower than a known centerbody (not shown) with all ten apertures substantially identical in size inducing substantially similar flow rates through each of the ten apertures. Therefore, apertures 7-9 induce a total second radial fuel exit stream 176 representing an approximate 15% reduction in the total flow rate. As such, apertures 1-6 and 10 are sized to induce a total first radial fuel exit stream (not shown) that recovers the 15% reduction such that the total fuel injection through centerbody 170 and the known centerbody are substantially similar. Alternatively, the decreases and increases of the fuel for each individual aperture 172 are any values the enable operation centerbody 170 and fuel nozzle assembly 100 as described herein.

Also, in this alternative embodiment, air 152 is introduced into swirl chamber 139 through swirl vanes (not shown) of main swirler 24. Air 152 mixes with fuel 140 to form fuel-air mixture swirl 154 that is directed towards combustion chamber 52.

Further, in this alternative embodiment, apertures 7-9 were selected for a reduction in diameter as a function of observed and/or modeled swirl patterns of fuel-air mixture swirl 154. The observed and/or modeled fuel flow from centerbody 170 results in decreasing fuel injected into combustor chamber 52 through each fuel nozzle assembly 100 from approaching and combusting in the vicinity of outer liners 54. Also, a smaller portion of high-temperature combustion gases is directed toward outer liners 54 since the reduced fuel exiting apertures 7-9 that is combusted achieves in a reduction in the combustion gases resulting therefrom. As such, the thermal loading of outer liners 54 is significantly decreased, thereby increasing a margin to thermal parameters for outer liners 54 and extending their service life. In the exemplary embodiment, the reduction in thermal loading of outer liners 54 is achieved through reducing the diameter of fuel apertures 7-9 and increasing the diameter of apertures 1-6 and 10. Alternatively, similar results may be achieved through one or more of, and without limitation, selectively altering the respective shapes of apertures 1 through 10, e.g., and without limitation, ovular shaped apertures, and installing flow restriction devices within apertures 7-9. In one embodiment of alternative centerbody 170, as described above, apertures 7-9 induce a total second radial fuel exit stream 176 representing an approximate 15% reduction in the total flow rate. As such, apertures 1-6 and 10 are sized to induce a total first radial fuel exit stream that recovers the 15% reduction such that the total fuel injection through exemplary centerbody 170 and the known centerbody are substantially similar.

Further, in another alternative embodiment, a fifth pair of adjacent apertures 1 and 2 define a fifth circumferential distance $CD_5$ therebetween and a sixth pair of adjacent apertures 4 and 5 define a sixth circumferential distance $CD_5$ therebetween, where $CD_5$ and $CD_6$ are substantially equal. $CD_5$ and $CD_6$ are substantially equal to $CD_1$ and $CD_2$. Alternatively, $CD_5$ and $CD_6$ are different from $CD_1$ and $CD_2$. Also, in this embodiment, a third pair of adjacent apertures 2 and 3 define a seventh circumferential distance $CD_7$ therebetween and an eighth pair of adjacent apertures 3 and 4 define an eighth circumferential distance $CD_8$ therebetween. $CD_7$ is less than $CD_8$, $CD_8$ is greater than $CD_5$ and $CD_6$, and $CD_7$ is less than $CD_5$ and $CD_6$.

In operation, fuel 140 is delivered to centerbody 108 from fuel nozzle stem 136 (shown in FIGS. 4-6). A first radial fuel exit stream (not shown) is induced through each of apertures 1 and 5-10 and a second radial fuel exit stream 178 is induced through each of apertures 2-4. In this alternative embodiment, each second radial fuel exit stream 178 has a flow rate that is approximately 5% lower than a known centerbody (not shown) with all ten apertures substantially identical in size inducing substantially similar flow rates through each of the ten apertures. Therefore, apertures 2-4 induce a total second radial fuel exit stream 180 representing an approximate 15% reduction in the total flow rate. As such, apertures 1 and 5-10 are sized to induce a total first radial fuel exit stream (not shown) that recovers the 15% reduction such that the total fuel injection through centerbody 170 and the known centerbody are substantially similar. Alternatively, the decreases and increases of the fuel for each individual aperture 172 are any values the enable operation centerbody 170 and fuel nozzle assembly 100 as described herein.

Further, in this alternative embodiment, apertures 2-4 were selected for a reduction in diameter as a function of observed and/or modeled swirl patterns of fuel-air mixture swirl 154. The observed and/or modeled fuel flow from centerbody 170 results in decreasing fuel injected into combustor chamber 52 through each fuel nozzle assembly 100 from approaching and combusting in the vicinity of inner liners 56. Also, a smaller portion of high-temperature combustion gases is directed toward inner liners 56 since the reduced fuel exiting apertures 2-4 that is combusted achieves in a reduction in the combustion gases resulting therefrom. As such, the thermal loading of inner liners 56 is significantly decreased, thereby increasing a margin to thermal parameters for inner liners 56 and extending their service life. In the exemplary embodiment, the reduction in thermal loading of inner liners 56 is achieved through reducing the diameter of fuel apertures 2-4 and increasing the diameter of apertures 1 and 5-10. Alternatively, similar results may be achieved through one or more of, and without limitation, selectively altering the respective shapes of apertures 1 through 10, e.g., and without limitation, ovular shaped apertures, and installing flow restriction devices within apertures 2-4. In one embodiment of alternative centerbody 170, as described above, apertures 2-4 induce a total second radial fuel exit stream 180 representing an approximate 15% reduction in the total flow rate. As such, apertures 1 and 5-10 are sized to induce a total first radial fuel exit stream that recovers the 15% reduction such that the total fuel injection through exemplary centerbody 170 and the known centerbody are substantially similar.

Figure 10:
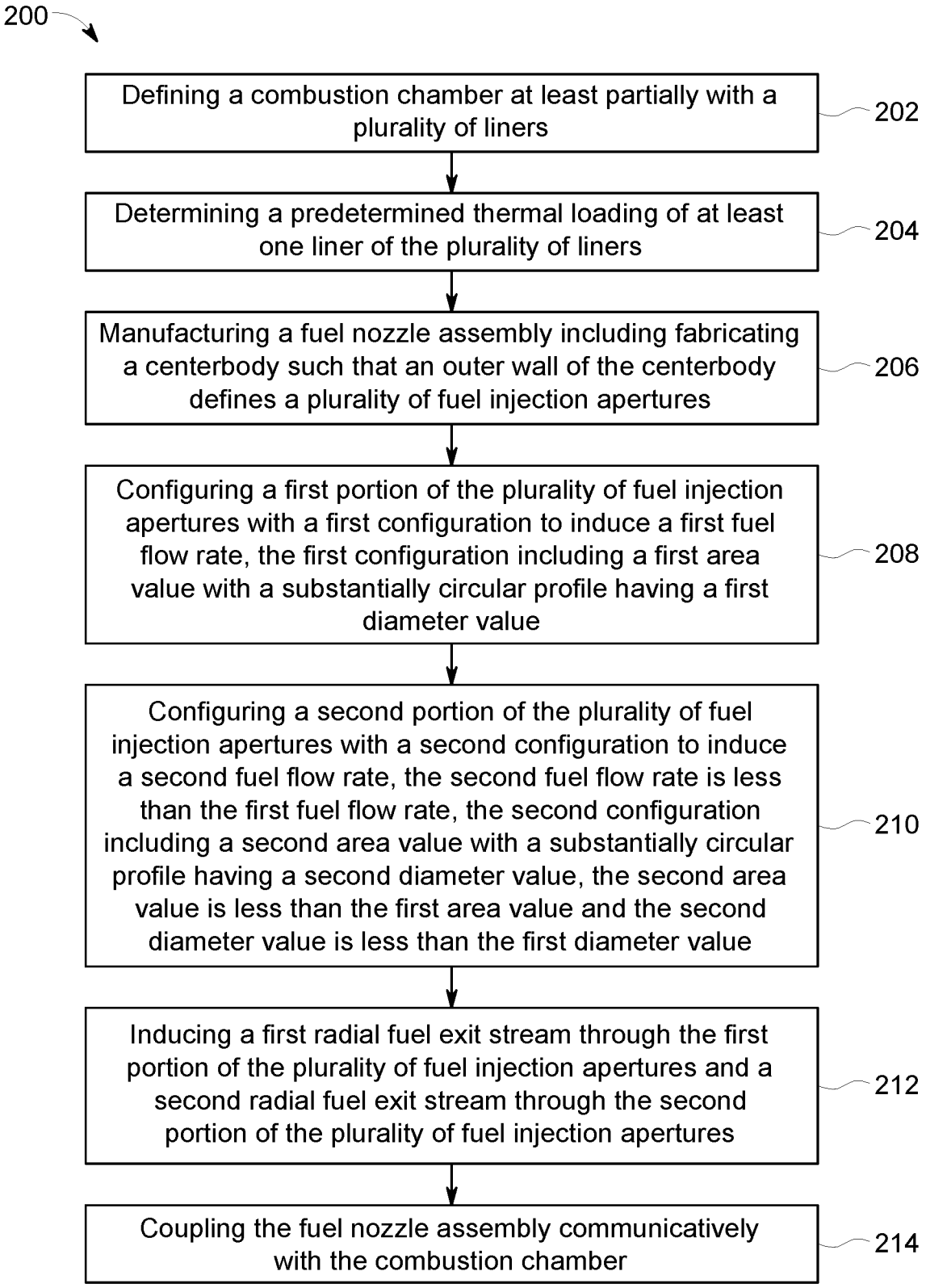
FIG. 10 is a flow chart of an exemplary method of assembling the combustor shown in FIG. 2.

FIG. 10 is a flow chart of an exemplary method 200 of assembling combustor 22 (shown in FIG. 2). Referring to FIGS. 2, 7, and 8, method 200 includes defining 202 combustion chamber 52 at least partially with a plurality of liners, i.e., inner liner 56 and outer liner 54. Method 200 also includes determining 204 a predetermined thermal loading of outer liner 56 and inner liner 54. Method 200 further includes manufacturing 206 fuel nozzle assembly 100 including fabricating centerbody 108 such that outer sidewall 120 of centerbody 108 defines plurality of fuel injection apertures 124. Method 200 also includes configuring 208 first portion 142 of fuel injection apertures 124 with a first configuration to induce a first fuel flow rate, the first configuration including a first area with a substantially circular profile having a first diameter $D_1$. Method 200 further includes configuring 210 second portion 144 of fuel injection apertures 124 with a second configuration to induce a second fuel flow rate that is less than the first fuel flow rate. The second configuration includes a second area with a substantially circular profile having a second diameter $D_2$. The second area is less than the first area and the second diameter $D_2$ is less than the first diameter $D_1$. Method 200 also includes inducing 212 a first radial fuel exit stream 146 through first portion 142 of fuel injection apertures 124 and a second radial fuel exit stream 148 through second portion 144 of fuel injection apertures 124. Method 200 further includes coupling 214 fuel nozzle assembly 100 communicatively with combustion chamber 52.

The above-described fuel injection systems facilitate decreasing fuel injected into a combustor through a plurality of fuel nozzles from approaching and combusting in the vicinity of the combustors' outer liners and/or the inner liners. Also, a smaller portion of high-temperature combustion gases is directed toward the outer liners and the inner liners. As such, the thermal loading, i.e., temperature of the outer liners and the inner liners is significantly decreased, thereby increasing a margin to thermal parameters for the outer liners and the inner liners and extending their service life. In the embodiments disclosed herein, at least a portion of circumferential apertures defined in the center bodies of the fuel nozzles are sized differently, thereby tuning the fuel nozzles. More specifically, a first portion of selected apertures are increased in size to substantially maintain a predetermined total fuel flow through the full set of apertures into the fuel nozzles while a second portion of selected apertures are decreased in size to facilitate a decrease in flow through the selected apertures. The selection of the apertures to decrease in size is at least partially based on the characteristics of the clockwise swirl induced within the centerbody. As such, the flow rate of fuel is controlled at each injection point, i.e., aperture to preferentially distribute the fuel injection to facilitate regulation of the temperature on the inner and outer liners through a known relationship between a percentile biasing of the fuel flow through each aperture to attain a predetermined temperature change in the temperature of the liners.

An exemplary technical effect of the methods, systems, and apparatus described herein includes at least one of: (a) tuning the fuel nozzles to inject fuel through the associated apertures at predetermined flow rate based on the characteristics of the swirling pattern in the centerbody of the fuel nozzle; (b) decreasing fuel and hot gas injection toward the outer liners and the inner liners of the combustors; (c) decreasing the thermal loading, i.e., the temperatures of the outer liners and the inner liners away from thermal parameters; and (d) extending the service life of the outer liners and the inner liners in the combustors.

Exemplary embodiments of methods, systems, and apparatus for a fuel injection system are not limited to the specific embodiments described herein, but rather, components of systems and steps of the methods may be utilized independently and separately from other components and steps described herein. For example, the methods may also be used in combination with other fuel injection assemblies, and are not limited to practice with only the fuel injection system and methods as described herein. Rather, the exemplary embodiment can be implemented and utilized in connection with many other applications, equipment, and systems that may benefit from the advantages described herein.

Although specific features of various embodiments of the disclosure may be shown in some drawings and not in others, this is for convenience only. In accordance with the principles of the disclosure, any feature of a drawing may be referenced and claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fuel nozzle assembly comprising a centerbody, the centerbody comprising an outer wall, said outer wall defining a plurality of fuel injection apertures and at least partially defining a swirl chamber, said swirl chamber coupled in flow communication with said plurality of fuel injection apertures, said plurality of fuel injection apertures defined in said outer wall sequentially and circumferentially to define a substantially circular configuration thereon, the fuel nozzle assembly comprising:

a first portion of said plurality of fuel injection apertures configured to induce a first fuel flow rate radially outward, relative to a fuel nozzle assembly centerline, through said first portion of said plurality of fuel injection apertures; and a second portion of said plurality of fuel injection apertures configured to induce a second fuel flow rate radially outward, relative to the fuel nozzle assembly centerline, through said second portion of said plurality of fuel injection apertures, wherein the second fuel flow rate is less than the first fuel flow rate, wherein a first aperture, a second aperture, a third aperture, a fourth aperture, and a fifth aperture of said plurality of fuel injection apertures are arranged in sequence, wherein a first circumferential distance is defined between said first aperture and said second aperture, wherein a second circumferential distance is defined between said second aperture and said third aperture, wherein a third circumferential distance is defined between said third aperture and said fourth aperture, wherein a fourth circumferential distance is defined between said fourth aperture and said fifth aperture, wherein said first circumferential distance and said fourth circumferential distance are substantially equal, wherein said third circumferential distance is greater than said first circumferential distance, and wherein said second circumferential distance is less than said first circumferential distance.

2. The fuel nozzle assembly in accordance with claim 1, wherein said first portion of said plurality of fuel injection apertures has a first configuration and said second portion of said plurality of fuel injection apertures has a second configuration.

3. The fuel nozzle assembly in accordance with claim 1, wherein the fuel nozzle assembly comprises 10 fuel injection apertures disposed within the centerbody.

4. The fuel nozzle assembly in accordance with claim 1, wherein said first portion of said plurality of fuel injection apertures are substantially circular and have a first diameter and said second portion of said plurality of fuel injection apertures are substantially circular and have a second diameter, wherein the second diameter is less than the first diameter, the fuel nozzle assembly further comprising:

at least one plug;

at least one fuel;

at least one venturi; and at least one heat shield.

5. The fuel nozzle assembly in accordance with claim 4, wherein each of the at least one plug, the centerbody, the at least one fuel delivery system, the at least one venturi, and the at least one heat shield are centered about the fuel nozzle assembly centerline.

6. The fuel nozzle assembly in accordance with claim 5, wherein each fuel injection aperture of said plurality of fuel injection apertures is disposed in the centerbody upstream from an aft end of the centerbody.

7. The fuel nozzle assembly in accordance with claim 5, wherein said first portion of said plurality of fuel injection apertures is configured to induce a first radial fuel exit stream therethrough and said second portion of said plurality of fuel injection apertures is configured to induce a second radial fuel exit stream therethrough, wherein said first portion of said plurality of fuel injection apertures comprising said first diameter comprises at least seven of said fuel injection apertures, and wherein said second portion of said plurality of fuel injection apertures comprising said second diameter comprises at least three of said fuel injection apertures.

8. The fuel nozzle assembly in accordance with claim 1, wherein each fuel injection aperture of said plurality of fuel injection apertures comprises a different diameter than every other fuel injection aperture of said plurality of fuel injection apertures.

9. A combustor for a turbine engine assembly, said combustor comprising:

a plurality of liners at least partially defining a combustion chamber;

a fuel nozzle assembly communicatively coupled with said combustion chamber, said fuel nozzle assembly comprising a centerbody comprising an outer wall, said outer wall defining a plurality of fuel injection apertures and at least partially defining a swirl chamber, said swirl chamber coupled in flow communication with said plurality of fuel injection apertures, said plurality of fuel injection apertures defined in said outer wall sequentially and circumferentially to define a substantially circular configuration thereon, said fuel nozzle assembly comprising:

a first portion of said plurality of fuel injection apertures configured to induce a first fuel flow rate radially outward therethrough relative to a fuel nozzle assembly centerline; and a second portion of said plurality of fuel injection apertures configured to induce a second fuel flow rate radially outward therethrough relative to the fuel nozzle assembly centerline, wherein the second fuel flow rate is less than the first fuel flow rate, wherein a first aperture, a second aperture, a third aperture, a fourth aperture, and a fifth aperture of said plurality of fuel injection apertures are arranged in sequence, wherein a first circumferential distance is defined between said first aperture and said second aperture, wherein a second circumferential distance is defined between said second aperture and said third aperture, wherein a third circumferential distance is defined between said third aperture and said fourth aperture, wherein a fourth circumferential distance is defined between said fourth aperture and said fifth aperture, wherein said first circumferential distance and said fourth circumferential distance are substantially equal, wherein said third circumferential distance is greater than said first circumferential distance, and wherein said second circumferential distance is less than said first circumferential distance.

10. The combustor in accordance with claim 9, wherein said first portion of said plurality of fuel injection apertures has a first configuration and said second portion of said plurality of fuel injection apertures has a second configuration.

11. The combustor in accordance with claim 9, wherein said first portion of said plurality of fuel injection apertures are substantially circular and have a first diameter and said second portion of said plurality of fuel injection apertures are substantially circular and have a second diameter, wherein the second diameter is less than the first diameter, and wherein said plurality of fuel injection apertures comprises at least one fuel injection aperture having an oval shaped aperture.

12. The combustor in accordance with claim 9, wherein a configuration of said second portion of said plurality of fuel injection apertures is configured to reduce a thermal loading of at least one liner of said plurality of liners.

13. The combustor in accordance with claim 9, wherein said first portion of said plurality of fuel injection apertures is configured to induce a first radial fuel exit stream therethrough and said second portion of said plurality of fuel injection apertures is configured to induce a second radial fuel exit stream therethrough, and wherein the second fuel flow rate is 5% lower than said first fuel flow rate.

14. A method of assembling a combustor, said method comprising:

defining a combustion chamber at least partially with a plurality of liners;

manufacturing a fuel nozzle assembly comprising fabricating a centerbody with an outer wall, the outer wall defining a plurality of fuel injection apertures and at least partially defining a swirl chamber, the swirl chamber coupled in flow communication with the plurality of fuel injection apertures, the plurality of fuel injection apertures defined in the outer wall sequentially and circumferentially to define a substantially circular configuration thereon, the method comprising:

configuring a first portion of the plurality of fuel injection apertures with a first configuration to induce a first fuel flow rate radially outward therethrough relative to a fuel nozzle assembly centerline; and configuring a second portion of the plurality of fuel injection apertures with a second configuration to induce a second fuel flow rate radially outward therethrough, wherein the second fuel flow rate is less than the first fuel flow rate, wherein a first aperture, a second aperture, a third aperture, a fourth aperture, and a fifth aperture of the plurality of fuel injection apertures are arranged in sequence, wherein a first circumferential distance is defined between the first aperture and the second aperture, wherein a second circumferential distance is defined between the second aperture and the third aperture, wherein a third circumferential distance is defined between the third aperture and the fourth aperture, wherein a fourth circumferential distance is defined between the fourth aperture and the fifth aperture, wherein the first circumferential distance and the fourth circumferential distance are substantially equal, wherein the third circumferential distance is greater than the first circumferential distance, and wherein the second circumferential distance is less than the first circumferential distance; and coupling the fuel nozzle assembly communicatively with the combustion chamber.

15. The method in accordance with claim 14, wherein:

configuring the first portion of the plurality of fuel injection apertures comprises forming each fuel injection aperture of the first portion of the plurality of fuel injection apertures with a first area; and configuring the second portion of the plurality of fuel injection apertures comprises forming each fuel injection aperture of the second portion of the plurality of fuel injection apertures with a second area, wherein the second area is less than the first area, the method further comprising:

inducing a first radial fuel exit stream through the first portion of the plurality of fuel injection apertures.

16. The method in accordance with claim 15, wherein:

forming the first portion of the plurality of fuel injection apertures with the first area comprises forming the first portion of the plurality of fuel injection apertures with a substantially circular profile having a first diameter; and forming the second portion of the plurality of fuel injection apertures with the second area comprises forming the second portion of the plurality of injection apertures with a substantially circular profile having a second diameter, wherein the second diameter is less than the first diameter, the method further comprising:

inducing a second radial fuel exit stream through the second portion of the plurality of fuel injection apertures.

17. The method in accordance with claim 14, wherein configuring the second portion of the plurality of fuel injection apertures comprises configuring the second portion of the plurality of fuel injection apertures to reduce a thermal loading of at least one liner of the plurality of liners.

* * * * *